US008866579B2

(12) United States Patent
Hachiya et al.

(10) Patent No.: US 8,866,579 B2
(45) Date of Patent: Oct. 21, 2014

(54) LAMINATED INDUCTOR

(71) Applicant: Taiyo Yuden Co., Ltd., Tokyo (JP)

(72) Inventors: Masahiro Hachiya, Takasaki (JP); Takayuki Arai, Takasaki (JP); Kenji Otake, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/679,291

(22) Filed: Nov. 16, 2012

(65) Prior Publication Data

US 2013/0127576 A1 May 23, 2013

(30) Foreign Application Priority Data

Nov. 17, 2011 (JP) ..... 2011-252099

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 27/255*** | (2006.01) |

(52) U.S. Cl.

CPC ..... *H01F 27/255* (2013.01); *H01F 17/0033* (2013.01); *H01F 27/2804* (2013.01)

USPC ..... 336/200; 336/232; 336/223

(58) Field of Classification Search

USPC ..... 336/200, 223, 232

See application file for complete search history.

(56) References Cited

U.S. PATENT DOCUMENTS

| | | | | |
|---|---|---|---|---|
| 4,129,444 | A | 12/1978 | Dreyer et al. | |
| 5,352,522 | A | 10/1994 | Kugimiya et al. | |
| 5,522,946 | A | 6/1996 | Tomita et al. | |
| 6,392,525 | B1 | 5/2002 | Kato et al. | |
| 6,515,561 | B2 | 2/2003 | Tamura et al. | |
| 6,675,462 | B1 | 1/2004 | Takahashi | |
| 6,764,643 | B2 | 7/2004 | Sagawa et al. | |
| 6,784,782 | B2 | 8/2004 | Inoue et al. | |
| 6,814,928 | B2 | 11/2004 | Sagawa et al. | |
| 7,422,697 | B2 * | 9/2008 | Takahashi et al. | 252/62.55 |
| 7,446,638 | B2 | 11/2008 | Nogi | |
| 8,018,313 | B2 | 9/2011 | Tada et al. | |
| 8,416,051 | B2 | 4/2013 | Matsuura et al. | |
| 2004/0140016 | A1 | 7/2004 | Sakamoto et al. | |
| 2004/0209120 | A1 | 10/2004 | Inoue et al. | |

(Continued)

FOREIGN PATENT DOCUMENTS

| | | | |
|---|---|---|---|
| CN | 101308719 | A | 11/2008 |
| CN | 101927344 | A | 12/2010 |

(Continued)

*Primary Examiner* — Elvin G Enad

*Assistant Examiner* — Ronald Hinson

(74) *Attorney, Agent, or Firm* — Law Office of Katsuhiro Arai

(57) ABSTRACT

A laminated inductor offers higher magnetic permeability, high inductance, low resistance and high rated current, while also supporting downsizing of device, by using a soft magnetic alloy as the magnetic material. Provided is a laminated inductor, comprising: an internal conductor forming area and a top cover area and a bottom cover area formed in a manner sandwiching the internal conductor forming area from above and below, wherein the internal conductor forming area has a magnetic material part formed by soft magnetic alloy particles, and internal conductors buried in the magnetic material part, and at least one of the top cover area and bottom cover area is formed by soft magnetic alloy particles exhibiting a two-peak particle size distribution curve (based on count).

12 Claims, 3 Drawing Sheets

(56) References Cited

U.S. PATENT DOCUMENTS

| | | | |
|---|---|---|---|
| 2007/0290161 | A1 | 12/2007 | Tokuoka et al. |
| 2008/0003126 | A1 | 1/2008 | Watanabe et al. |
| 2008/0012679 | A1 | 1/2008 | Okabe et al. |
| 2008/0029300 | A1 | 2/2008 | Harada et al. |
| 2008/0061264 | A1 | 3/2008 | Maeda et al. |
| 2008/0152897 | A1 | 6/2008 | Maeda et al. |
| 2008/0231409 | A1 | 9/2008 | Kugai et al. |
| 2008/0278273 | A1 | 11/2008 | Lee et al. |
| 2009/0045905 | A1 | 2/2009 | Nakagawa et al. |
| 2009/0102589 | A1 | 4/2009 | Lee et al. |
| 2010/0253463 | A1 | 10/2010 | Shimomura et al. |
| 2010/0289609 | A1 | 11/2010 | Liao et al. |
| 2011/0024670 | A1 | 2/2011 | Otsuki et al. |
| 2011/0133881 | A1 | 6/2011 | Nakajima et al. |
| 2011/0227690 | A1 | 9/2011 | Watanabe et al. |
| 2011/0267167 | A1 | 11/2011 | Ogawa et al. |
| 2012/0038449 | A1 | 2/2012 | Ogawa et al. |
| 2012/0070567 | A1 | 3/2012 | Watanabe et al. |

FOREIGN PATENT DOCUMENTS

| | | | |
|---|---|---|---|
| CN | 102007549 | A | 4/2011 |
| JP | H04-105511 | U | 9/1992 |
| JP | H04-346204 | A | 12/1992 |
| JP | 1993-66920 | U | 9/1993 |
| JP | 07-201570 | A | 8/1995 |
| JP | H09-074011 | A1 | 3/1997 |
| JP | H11-317308 | A1 | 11/1999 |
| JP | 2000-030925 | A1 | 1/2000 |
| JP | 2000-348939 | A1 | 12/2000 |
| JP | 2001-011563 | A1 | 1/2001 |
| JP | 2001-044037 | A1 | 2/2001 |
| JP | 2001-118725 | A1 | 4/2001 |
| JP | 2002-305108 | A1 | 10/2002 |
| JP | 2002-313620 | A1 | 10/2002 |
| JP | 2002-343618 | A1 | 11/2002 |
| JP | 2005286145 | A | 10/2005 |
| JP | 2007-012920 | A | 1/2007 |
| JP | 2007-019134 | A1 | 1/2007 |
| JP | 2007-027353 | A1 | 2/2007 |
| JP | 2007-027354 | A | 2/2007 |
| JP | 2007-123703 | A1 | 5/2007 |
| JP | 2007-258427 | A | 10/2007 |
| JP | 2007-299871 | A1 | 11/2007 |
| JP | 2007-123703 | A1 | 2/2008 |
| JP | 2008-028162 | A1 | 2/2008 |
| JP | 2008-195986 | A1 | 8/2008 |
| JP | 2009-088496 | A1 | 4/2009 |
| JP | 2009-088502 | A1 | 4/2009 |
| JP | 2011-249774 | A1 | 12/2011 |
| TW | 200845057 | A | 11/2008 |
| TW | M388724 | U1 | 9/2010 |
| WO | 2009/128425 | A1 | 10/2009 |
| WO | 2010/013843 | A1 | 2/2010 |

* cited by examiner where $t1 < t3, t3 > t5$ $t1 \times 0.95 > t2$ $t5 \times 0.95 > t4$

LAMINATED INDUCTOR

BACKGROUND

1. Field of the Invention

The present invention relates to a laminated inductor.

2. Description of the Related Art

One conventionally known method to manufacture a laminated inductor is to print internal conductor patterns on ceramic green sheets containing ferrite, etc., and then stack these sheets to be sintered.

Under a representative manufacturing method for laminated inductor, through holes are formed at specified locations on ceramic green sheets made from ferrite powder. Next, a conductive paste is used to print coil conductor patterns (internal conductor patterns) on one primary side of each sheet having through holes formed on it, so that when the sheets are stacked, the through holes will be connected together and spiral coils will be formed as a result.

Next, the sheets having through holes and coil conductor patterns formed on them are stacked according to a specified configuration, with a ceramic green sheet (dummy sheet) having no through holes or coil conductor patterns stacked at the top and also at the bottom. Next, the obtained stack is pressure-bonded and then sintered, after which external electrodes are formed on the end faces onto which the ends of coils are led out, to obtain a laminated inductor.

There has been a demand for laminated inductors supporting large current (higher rated current) in recent years. According to Patent Literature 1, for example, switching the magnetic material from conventional ferrite to soft magnetic alloy is being studied in order to meet this demand. Soft magnetic alloys proposed for this purpose, such as Fe—Cr—Si alloy and Fe—Al—Si alloy, have a higher saturated magnetic flux density than that of ferrite. On the other hand, these materials have a much lower volume resistivity compared to that of conventional ferrite.

BACKGROUND ART LITERATURES

[Patent Literature 1] Japanese Patent Laid-open No. 2007-27353

SUMMARY

To meet the high inductance or low height required by the market, it is desirable to use a material of high magnetic permeability. Methods to obtain a material of high magnetic permeability include: (1) increasing the fill ratio of metal magnetic material, (2) using a metal magnetic material of large particle size, (3) using a particle whose constitution supports high magnetic permeability, and (4) using a particle having an easily magnetized axis in the direction of magnetic flux. With a laminated inductor, however, magnetic permeability becomes low for the following reasons and achieving a desired inductance or product height is therefore difficult. The specific reasons include: (1) difficulty raising the proportion of metal magnetic material because pressure-bonding is implemented together with the internal electrodes and therefore high forming pressure cannot be applied, (2) limitation of the particle size that can be used because inclusion of particles larger than the width between internal electrodes results in short-circuiting or disconnection, and (3) difficulty raising the proportion of metal magnetic material because an amorphous or other magnetic powder of high magnetic permeability is associated with high powder strength or has a flat or other non-spherical shape.

In light of the above, the object of the present invention is to provide a laminated inductor offering higher magnetic permeability, high inductance, low resistance, and high rated current, while also supporting downsizing of devices, by using a soft magnetic alloy as the magnetic material.

Any discussion of problems and solutions involved in the related art has been included in this disclosure solely for the purposes of providing a context for the present invention, and should not be taken as an admission that any or all of the discussion were known at the time the invention was made.

After studying in earnest, the inventors of the present invention completed a laminated inductor having an internal conductor forming area as well as a top cover area and bottom cover area formed in a manner sandwiching the internal conductor forming area from above and below. According to the present invention, the internal conductor forming area has a magnetic material part formed by soft magnetic alloy particles, and internal conductors buried in the magnetic material part, wherein at least one of the top cover area and bottom cover area is formed by soft magnetic alloy particles exhibiting a two-peak particle size distribution curve (based on count).

Preferably the soft magnetic alloy particles in the magnetic material part of the internal conductor forming area have the same types of constituent elements as the soft magnetic alloy particles exhibiting a two-peak particle size distribution curve.

Also preferably the ratio of particle size a at the peak on the small particle size side and particle size b at the peak on the large particle size side of the two peaks, or a/b, is 0.18 or less.

Also preferably the ratio of height t1 at the peak on the small particle size side and height t2 at the peak on the large particle size side of the two peaks, or t1/t2, is 0.1 to 0.5.

Also preferably there is a relationship of $a<c<b$ among the particle size a at the peak on the small particle size side and particle size b at the peak on the large particle size side of the two peaks, and c being the value of D50 of the soft magnetic alloy particle at the magnetic material part of the internal conductor forming area.

According to the present invention, use of large-size soft magnetic alloy particles for the cover areas improves the magnetic permeability of the device as a whole and consequently the L value of the inductor improves and low resistance and high rated current can be expected. Use of small-size soft magnetic alloy particles for the magnetic material part of the internal conductor forming area makes it hard for short-circuiting or wire breakage to occur in the internal conductors and consequently the device can be made smaller. Constituting the soft magnetic alloy particles for the top and bottom cover areas and soft magnetic alloy particles for the magnetic material part of the internal conductor forming area using soft magnetic alloys of an identical composition or similar compositions improves the bonding strength between the top and bottom cover areas and internal conductor forming area, which contributes to improved strength of the device as a whole.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
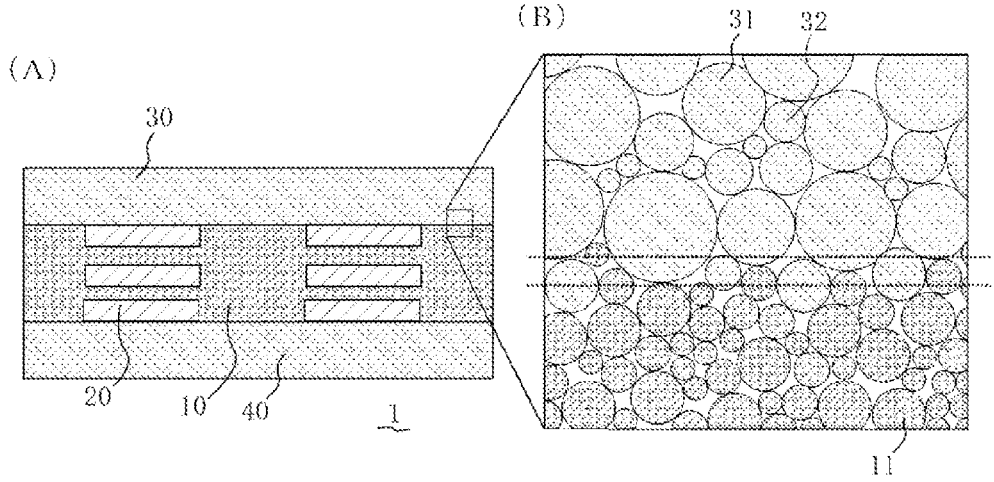
FIG. 1 is a schematic section view of a laminated inductor according to an embodiment of the present invention.

1 Laminated inductor
10 Magnetic material part of internal conductor forming area
11 Soft magnetic alloy particle
20 Internal conductor
30 Top cover area
31, 32 Soft magnetic alloy particle
40 Bottom cover area,
ML1 to ML6: Each magnetic layer,
CS2 to CS5: Coil segment,
IS1 to IS4: Relay segment

DETAILED DESCRIPTION OF EMBODIMENTS

The present invention is described in detail below using the drawings as deemed appropriate. It should be noted, however, that the present invention is not at all limited to the embodiments illustrated and that, because characteristic parts of the invention may be emphasized in the drawings, accuracy of the scale of each part of the drawings is not necessarily assured.

FIG. 1(A) is a schematic section view of a laminated inductor. FIG. 1(B) is an enlarged view showing a part of FIG. 1(A). According to the present invention, a laminated inductor 1 has an internal conductor forming area 10, 20 and a top cover area 30 and bottom cover area 40 present in a manner sandwiching the area 10, 20 from above and below. The internal conductor forming area has a magnetic material part 10 and internal conducive wires 20 provided in a manner buried therein. The top cover area 30 and bottom cover area 40 do not have internal conductors buried in them, and are virtually constituted by a magnetic material layer. Under the present invention, the terms "top" and "bottom" refer to the directions in which one cover layer (top cover layer) 30, internal conductor forming area 10, 20 and the other cover layer (bottom cover layer) 40 are stacked in this order from the top. The terms "top" and "bottom" do not limit the embodiments of use or manufacturing method of the laminated inductor 1 in any way. Either side may be specified as the top if the two cover layers 30, 40 have the same constitution.

The laminated inductor 1 proposed by the present invention has a structure whereby the internal conductors 20 are for the most part buried in magnetic material (magnetic material part 10). Typically the internal conductors 20 are spirally formed coils, in which case virtually circular, semi-circular or other conductive patterns are printed on green sheets by means of screen printing, etc., after which a conductor is filled in through holes and the sheets are stacked. The green sheets on which conductive patterns are printed contain magnetic material and have through holes provided at specified locations. It should be noted that, in addition to the spiral coils as illustrated, the internal conductors may be helical coils, meandering conductors or straight conductors, etc.

FIG. 1(B) is a schematic enlarged view of near the boundary of the magnetic material part 10 of the internal conductor forming area and the top cover area 30. With the laminated inductor 1, many soft magnetic alloy particles 11 are gathered to constitute the magnetic material part 10 of a specified shape. Similarly, many soft magnetic alloy particles 31 are gathered to constitute the top cover area 30 of a specified shape. The same applies to the bottom cover area 40, although not shown in FIG. 1(B). Individual soft magnetic alloy particles 11, 31, 32 have an oxide film formed virtually around their entire periphery, and these oxide films ensure insulation property of the magnetic material part 10, top cover area 30, and bottom cover area 40. In the drawing, oxide films are not illustrated. Adjacent soft magnetic alloy particles 11, 31, 32 are bonded together primarily via the oxide films around each of them to constitute the soft magnetic part 10, top cover area 30 and bottom cover area 40 of specified shapes. Adjacent soft magnetic alloy particles 11, 31, 32 may be partially bonded together at metal parts where no oxide film is present. Also near the internal conductors 20, soft magnetic alloy particles 11 and internal conductors 20 are in close contact, primarily via the oxide films. It has been confirmed that, if the soft magnetic alloy particles 11, 31, 32 are constituted by Fe-M-Si alloy (where M is a material oxidized more easily than iron), then the oxide film contains at least $Fe_3O_4$ being a magnetic material, as well as $Fe_2O_3$ and $MO_x$ (x is a value determined according to the oxidation number of metal M) being non-magnetic materials.

Presence of bonds between the aforementioned oxide films can be clearly determined by, for example, visually confirming on a SEM observation image of approx. 3000 in magnification, etc., that the oxide films of adjacent soft magnetic alloy particles 11, 31, 32 have an identical phase. Presence of bonds via oxide films improves the mechanical strength and insulation property of the laminated inductor 1. Preferably adjacent soft magnetic alloy particles 11, 31, 32 are bonded together via their oxide films across the laminated inductor 1, but as long as partial bonds are present, reasonable improvement in mechanical strength and insulation property can be achieved and such mode is also considered an embodiment of the present invention.

Similarly for the bonding of soft magnetic alloy particles 11, 31, 32 at metal parts where no oxide film is present, presence of direct bonding of soft magnetic alloy particles 11, 31, 32 can be clearly determined by, for example, visually confirming on a SEM observation image of approx. 3000 in magnification, etc., that the adjacent soft magnetic alloy particles 11, 31, 32 have bonding points while maintaining an identical phase. Presence of direct bonding of soft magnetic alloy particles 11, 31, 32 leads to further improvement in magnetic permeability.

It should be noted that a mode where adjacent soft magnetic alloy particles are only physically contacting or in close proximity with each other without presence of bonds via oxide films or bonds between metal parts not involving oxide films, may be partially present.

Present in the internal conductor forming area of the laminated inductor 1 are the magnetic material part 10, and the internal conductors 20 in the form of spiral coils, etc., provided in a manner buried in the magnetic material part 10. For the conductor constituting the internal conductors 20, any metal normally used for a laminated inductor can be used as deemed appropriate, where examples include, but are not limited to, silver and silver alloy. Typically both ends of internal conductors 20 are led out, respectively, to the opposing end faces on the outer surface of the laminated inductor 1 via lead conductors (not illustrated), and connected to external terminals (not illustrated).

According to the present invention, the top cover area 30 and bottom cover area 40 are present in a manner sandwiching the internal conductor forming area 10, 20. The top cover area 30 and bottom cover area 40 are areas each constituted by a layer where no internal conductors are formed.

At least one of the top cover area 30 and bottom cover area 40, or preferably both, is/are formed by soft magnetic alloy particles whose particle distribution characteristics are described in detail below.

To be specific, soft magnetic alloy particles forming at least one of the top cover area 30 and bottom cover area 40 have a particle size distribution curve with two peaks. FIG. 1(B) represents a mode where the top cover area 30 uses such soft magnetic alloy particles 31, 32 having a particle size distribution curve with two peaks.

Presence of soft magnetic alloy particles 31 of relatively large size is expected to induce expression of high magnetic permeability, while presence of soft magnetic alloy particles 32 of relatively small size increases the fill density of particles and thereby enables production of a laminated inductor offering high inductance, low resistance and low height.

Here, a particle size distribution curve of soft magnetic alloy particles can be obtained by capturing and analyzing a SEM image. To be specific, a SEM image (approx. 3000 in magnification) of a section of the measurement target area, such as the top cover area 30 or bottom cover area 40, is captured and at least 1000 particles are arbitrarily selected from the measurement area, after which the areas occupied by these particles are measured on the SEM image and the sizes of individual particles are calculated by assuming that the particles are spherical. The calculated particle sizes are represented along the horizontal axis, and the particle counts (frequencies) are represented along the vertical axis, to obtain a particle size distribution curve. Particles can be selected using the method specified below, for example. If less than 1000 particles are present on the SEM image, all particles on the SEM image are sampled and the same process is repeated at multiple locations to select at least 1000 particles. If 1000 or more particles are present on the SEM image, straight lines are drawn at a specified interval on the SEM image and all particles intersected by the straight lines are sampled to select at least 1000 particles. It should be noted that, with laminated inductors using soft magnetic alloy particles, the sizes of material particles are known to be roughly the same as the sizes of soft magnetic alloy particles constituting the magnetic material part 10 and cover areas 30, 40 after heat treatment. Accordingly, the average size of soft magnetic alloy particles included in the laminated inductor 1 can be assumed by measuring, beforehand, the average size of soft magnetic alloy particles used as the material.

Figure 2:
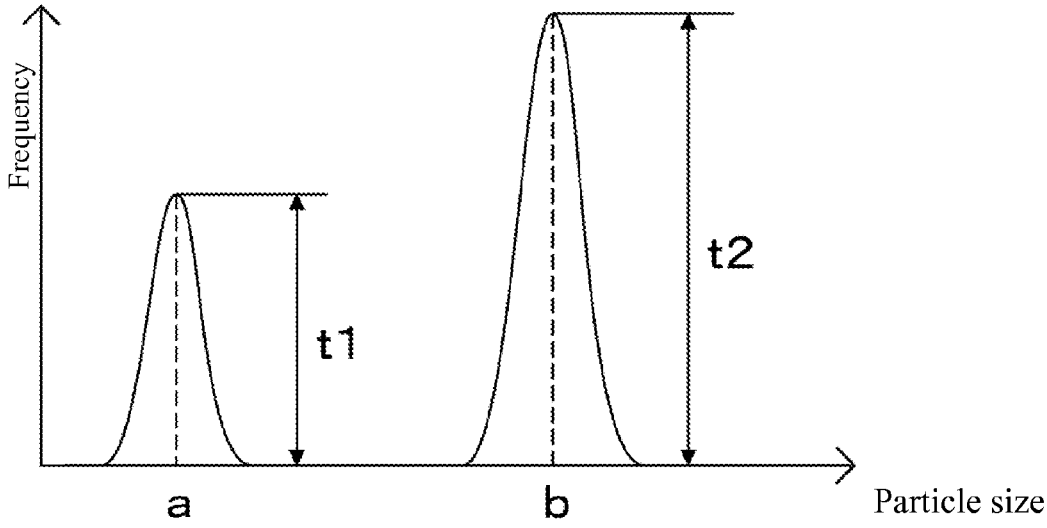
FIG. 2 is a schematic particle size distribution curve of soft magnetic alloy particles according to an embodiment of the present invention.

FIG. 2 is a schematic particle size distribution curve of soft magnetic alloy particles based on frequency (count). Here, among the two peaks the particle size at the peak on the small particle size side is defined as a, while the particle size at the peak on the large particle size side is defined as b. Also, the height at the peak on the small particle size side is defined as t1, while the height at the peak on the large particle size side is defined as t2. In FIG. 2, presence of the two peaks is emphasized. In reality, the two peaks may partially overlap each other.

Preferably the ratio of a and b, or a/b, is 0.18 or less. Also, preferably b is 10 μm or more. The upper limit of b can be set as deemed appropriate, such as 30 μm, according to the size of the device, etc. The lower limit of a is not specifically limited, but typical examples include 0.5 μm. Establishment of the above relationship between a and b allows the cover areas 30, 40 to be formed with soft magnetic alloy particles 31, 32 at a higher fill ratio, which in turn increases the effects of the present invention.

Also, preferably the ratio of t1 and t2, or t1/t2, is 0.1 to 0.5. Establishment of this relationship allows the cover areas 30, 40 to be formed with soft magnetic alloy particles 31, 32 at a higher fill ratio, which in turn increases the effects of the present invention. The heights of peaks on the particle size distribution curve t1 and t2 reflect the abundance ratios of particles of the particle sizes corresponding to the peaks, respectively.

One possible way to control the ratios of a/b and t1/t2 is to adjust the particle size distribution and blending ratio of the material powder. Typically the cover areas 30, 40 having the distribution shown in FIG. 2 can be obtained by blending, at a specified ratio, a group of particles having narrowly distributed particle sizes close to target a and a group of particles having narrowly distributed particle sizes close to target b.

Here, the value of D50 of soft magnetic alloy particles 11 in the magnetic material part 10 is defined as c. Preferably the relationship of $a<c<b$ is established. The value of c is obtained by obtaining a size distribution of at least 300 particles on a SEM image according to the aforementioned method for obtaining a size distribution curve of soft magnetic alloy particles, and then calculating the D50 value from this distribution. As long as the soft magnetic alloy particles 11 in the magnetic material part 10 are not too large, or $c<b$ is satisfied, the printing accuracy with an electrode paste, etc., used for forming internal electrodes 20 improves. From this viewpoint of improved printing accuracy, preferably c is in a range of 1 to 10 μm.

Figure 4:
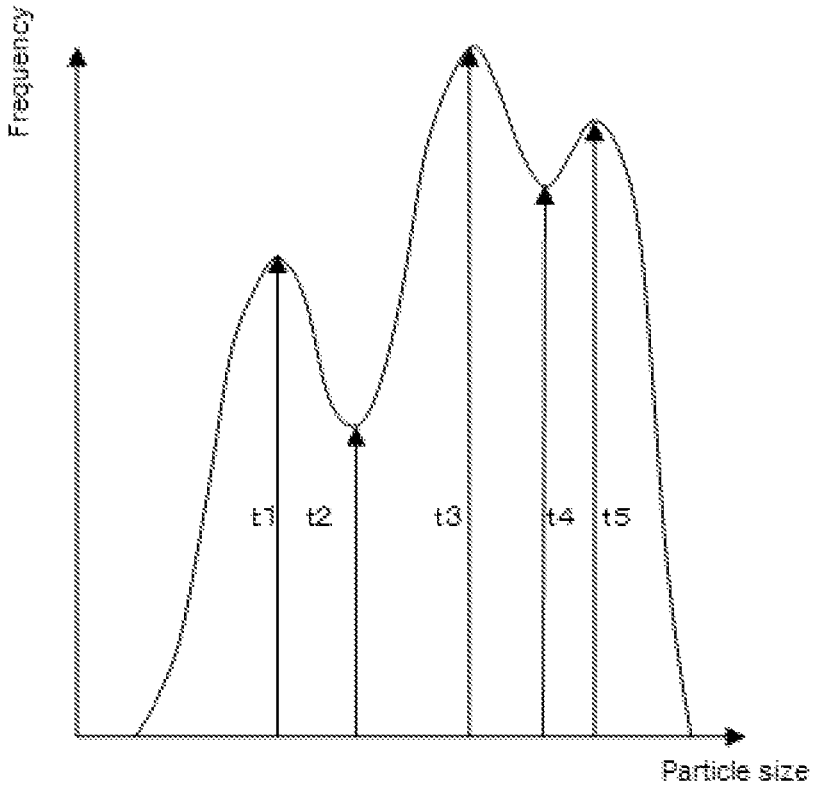
FIG. 4 is a schematic particle size distribution curve of soft magnetic alloy particles according to another embodiment of the present invention.

In some embodiments, the particles exhibiting the "two-peak particle size distribution curve" include particles exhibiting three or more peaks in a particle size distribution curve, particles exhibiting multiple peaks of distribution curves which overlap each other, and the like. For example, a "peak" is defined as illustrated in FIG. 4, where a peak is an apex of a distribution curve and has a value, 0.95 of which is greater than a value of a nadir between the peak and an adjacent peak. In some embodiments, the distribution curves having peaks do not overlap substantially each other as illustrated in FIG. 2.

Preferably the soft magnetic alloy particles 11 used for the magnetic material part 10 and soft magnetic alloy particles 31, 32 exhibiting a particle size distribution curve with two peaks have an identical composition or similar compositions, where, specifically, the types of constituent elements of soft magnetic alloy particles are identical between the magnetic material part 10 and the top cover area 30 or bottom cover area 40, and more preferably the types of constituent elements and abundance ratios of soft magnetic alloy particles are identical between the magnetic material part 10 and the top cover area 30 or bottom cover area 40. Identicalness of the types of constituent elements is explained by the following example. For example, presence of two types of soft magnetic alloys (Fe—Cr—Si soft magnetic alloys) each constituted by the three elements of Fe, Cr and Si means that the types of constituent elements of these alloys are identical regardless of the abundance ratios of Fe, Cr and Si.

The above constitution allows large soft magnetic alloy particles 31 to be contained in at least one of the top cover area 30 and bottom cover area 40, which results in improved magnetic permeability. According to the present invention, small soft magnetic alloy particles can be used for the magnetic material part 10 of the internal conductor forming area. For this reason, the internal conductors 20 do not break easily even when the device is made smaller and the wire size is reduced. As a result, improved magnetic permeability can be achieved with a smaller device. In particular, good bonding of the cover areas 30, 40 and the magnetic material part 10 of the internal conductor forming area can be achieved as long as the magnetic material part 10 and cover areas 30, 40 are constituted by soft magnetic alloy particles of an identical composition or similar compositions. In FIG. 1(A), the boundary of the top cover area 30 and the magnetic material part 10 of the internal conductor forming area is drawn in such a way that their materials are clearly different, but in reality soft magnetic alloy particles 31 used for the top cover area 30 and soft magnetic alloy particles 11 used for the magnetic material part 10 of the internal conductor forming area may be mixed together near the bonding boundary, as shown in FIG. 1(B) showing a partially enlarged view. The same applies to near the bonding boundary of the bottom cover area 40 and the magnetic material part 10 of the internal conductor forming area.

A typical, non-limited manufacturing method for the laminated inductor 1 according to the present invention is explained below. To manufacture the laminated inductor 1, first a coating machine such as a doctor blade, die coater or the like is used to apply a prepared magnetic paste (slurry) onto the surface of a base film made of resin, etc. The paste is then dried using a hot-air dryer or other dryer to obtain a green sheet. The magnetic paste contains soft magnetic alloy particles and, typically, a polymer resin as a binder, and solvent.

The soft magnetic alloy particles are primarily made of an alloy and exhibit soft magnetic property. The types of this alloy include Fe-M-Si alloys (M is a metal oxidized more easily than iron). M may be Cr, Al, etc., but is preferably Cr. The soft magnetic alloy particles may be manufactured by the atomization method, for example.

If M is Cr, or specifically in the case of a Fe—Cr—Si alloy, preferably the content of chromium is 2 to 8 percent by weight. Presence of chromium is desired because it becomes passive and suppresses excessive oxidation during heat treatment and also expresses strength and insulation resistance. On the other hand, however, less chromium is desired in that it improves magnetic characteristics. The above favorable range is proposed by considering these factors.

Preferably the content of Si in a Fe—Cr—Si soft magnetic alloy is 1.5 to 7 percent by weight. The greater the content of Si, the more preferable in terms of high resistance and high magnetic permeability, while a smaller Si content leads to good formability. The above favorable range is proposed by considering these factors.

With a Fe—Cr—Si alloy, preferably the remainder other than Si and Cr is iron, except for unavoidable impurities. Metals that can be contained besides Fe, Si and Cr include aluminum, magnesium, calcium, titanium, manganese, cobalt, nickel and copper, etc., while permitted non-metals include phosphorous, sulfur, and carbon, etc.

For the alloy constituting each soft magnetic alloy particle in the laminated inductor 1, its chemical composition can be calculated by, for example, capturing a section of the laminated inductor 1 using a scanning electron microscope (SEM) and then analyzing the image by the ZAF method based on energy dispersive X-ray spectroscopy (EDS).

According to the present invention, preferably the magnetic paste (slurry) for the magnetic material part 10 of the internal conductor forming area is manufactured separately from the magnetic paste (slurry) for the top cover area 30 and bottom cover area 40. At this time, the sizes, mixing ratio, etc., of soft magnetic alloy particles can be adjusted to meet the favorable conditions of a, b, c, t1 and t2 mentioned above.

The size distribution of soft magnetic alloy particles in the material stage can be measured with a particle size/granularity distribution measuring system that utilizes the laser diffraction/scattering method (such as Microtrack by Nikkiso (KK)). It has been shown that, with a laminated inductor 1 using soft magnetic alloy particles, the sizes of material soft magnetic alloy particles are roughly the same as the sizes of soft magnetic alloy particles 11, 31, 32 constituting the magnetic material part 10 and top and bottom cover areas 30, 40 of the completed laminated inductor 1.

Preferably each magnetic paste mentioned above contains a polymer resin as a binder. The type of this polymer resin is not specifically limited, and examples include polyvinyl acetal resins such as polyvinyl butyral (PVB) and the like. The type of solvent in the magnetic paste is not specifically limited, and butyl carbitol or other glycol ether can be used, for example. The blending ratio of soft magnetic alloy particles, polymer resin, solvent, etc., in the magnetic paste can be adjusted as deemed appropriate, and a specific viscosity, etc., of magnetic paste can also be set through such adjustment.

For the specific method to obtain green sheets by coating and drying a magnetic paste, any conventional technology can be applied as deemed appropriate.

Next, a stamping press, laser processing machine or other piercing machine is used to pierce through holes in the green sheets according to a specified layout. The layout of through holes is set in such a way that, when the sheets are stacked, the through holes filled with a conductor and conductive patterns together form the internal conductors 20. For the layout of through holes and the shapes of conductive patterns used to form the internal conductors, any conventional technology can be applied as deemed appropriate and specific examples are also explained in "Examples" by referring to the drawings.

Preferably a conductive paste is used to fill the through holes and also print the conductive patterns. The conductive paste contains conductive particles and, typically, a polymer resin as a binder, and solvent.

For the conductive particles, silver particles, etc., can be used. For the conductor particle size, preferably d50 is 1 to 10 μm based on volume. The d50 of conductive particles is measured with a particle size/granularity distribution measuring system that utilizes the laser diffraction/scattering method (such as Microtrack by Nikkiso (KK)).

Preferably the conductive paste contains a polymer resin as a binder. The type of this polymer resin is not specifically limited, and examples include polyvinyl acetal resins such as polyvinyl butyral (PVB) and the like. The type of solvent in the conductive paste is not specifically limited, and glycol ether such as butyl carbitol or the like can be used, for example. The blending ratio of conductive particles, polymer resin, solvent, etc., in the conductive paste can be adjusted as deemed appropriate, and a specific viscosity, etc., of conductive paste can also be set through such adjustment.

Next, a printer such as a screen printer, gravure printer or the like is used to print the conductive paste onto the surfaces of green sheets, which are then dried using a dryer such as a hot-air dryer or the like to form conductive patterns corresponding to the internal conductors. During printing, the conductive paste is partially filled in the through holes mentioned above. As a result, the conductive paste filled in the through holes and printed conductive patterns together constitute the shapes of internal conductors.

The printed green sheets are stacked in a specified order and then thermopressure-bonded using a suction transfer machine and press machine to produce a laminate. Next, the laminate is cut to the component size using a cutting machine such as a dicing machine, laser processing machine or the like, to produce a chip-before-heat-treatment including the magnetic material part and internal conductors before heat treatment.

A heating system such as sintering furnace or the like is used to heat-treat the chip-before-heat-treatment in an oxidizing atmosphere such as a standard atmosphere (or air) or the like. This heat treatment normally includes a binder removal process and oxide film forming process, where the binder removal process is implemented under a temperature condition of approx. 300° C. for approx. 1 hour, for example, that causes the polymer resin used as a binder to dissipate, while the oxide film forming process is implemented under a condition of preferably 400 to 900° C., but typically approx. 750° C., for approx. 2 hours, for example.

The chip-before-heat-treatment has many fine gaps among individual soft magnetic alloy particles, and normally these fine gaps are filled with a mixture of solvent and binder. This mixture disappears in the binder removal process and, once the binder removal process is completed, the fine gaps turn into pores. Also in the chip-before-heat-treatment, many fine gaps exist among conductive particles. These fine gaps are filled with a mixture of solvent and binder. This mixture also dissipates in the binder removal process.

In the oxide film forming process following the binder removal process, the magnetic material part 10 and top and bottom cover areas 30, 40 are formed as a result of tight gathering of soft magnetic alloy particles 11, 31, 32, and typically when this happens, oxide films are formed on the surfaces of soft magnetic alloy particles 11, 31, 32, respectively. At the same time the conductive particles are sintered to form the internal conductors 20. As a result, the laminated inductor 1 is obtained.

Normally, external terminals are formed after heat treatment. A coating machine such as a dip coater, roller coater, or the like is used to coat a prepared conductive paste on both longitudinal ends of the laminated inductor 1, which is then baked in a heating system such as a sintering furnace or the like under a condition of approx. 600° C. for approx. 1 hour, for example, to form external terminals. For the conductive paste for external terminals, the aforementioned paste for printing conductive patterns or other similar paste can be used as deemed appropriate.

EXAMPLES

The present invention is explained specifically using examples below. It should be noted, however, that the present invention is not at all limited to the embodiments described in these examples.

Example 1

[Specific Structure of Laminated Inductor]

An example of specific structure of the laminated inductor 1 manufactured in this example is explained. The laminated inductor 1, being a component, has a length of approx. 2.0 mm, width of approx. 1.25 mm and height of approx. 1.25 mm, and an overall shape of rectangular solid.

Figure 3:
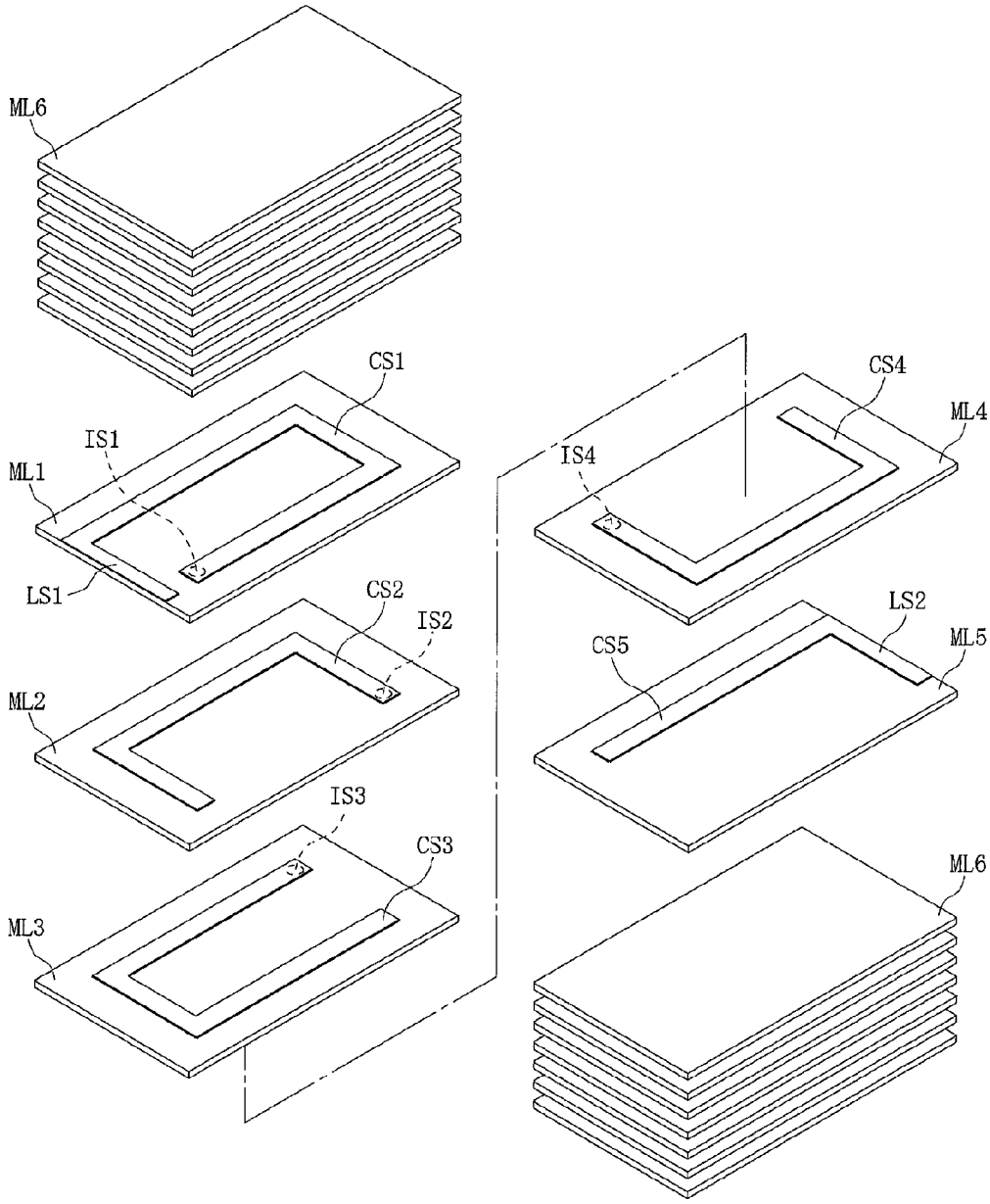
FIG. 3 is a schematic exploded view of a laminated inductor according to an embodiment of the present invention.

FIG. 3 is a schematic exploded view of the laminated inductor. The magnetic material part 10 of the internal conductor forming area has a structure whereby a total of five magnetic layers ML1 to ML5 are integrated together. The top cover area 30 has a structure whereby eight magnetic layers ML6 are integrated together. The bottom cover area 40 has a structure whereby seven magnetic layers ML6 are integrated together. Each of the magnetic layers ML1 to ML5 is formed primarily by soft magnetic alloy particles having one peak in their particle size distribution curve, containing Cr and Si with a D50 of 6 μm by 5 percent by weight and 3 percent by weight, respectively, with Fe accounting for the remainder, and free from glass component. The inventors of the present invention confirmed, by SEM observation (3000 in magnification), that an oxide film (not illustrated) was present on the surface of each soft magnetic alloy particle and that adjacent soft magnetic alloy particles in the magnetic material part 10 and top and bottom cover areas 30, 40 were bonded together via the oxide films on them.

The ML6 layers corresponding to the top and bottom cover areas were obtained by mixing soft magnetic alloy particles with a D50 of 1.5 μm and soft magnetic alloy particles with a D50 of 10 μm at a weight ratio of 1:4, and then adding the mixture to PVB as a binder, and solvent, with the ingredients mixed together and formed into sheets using the doctor blade method.

The internal conductors 20 have a coil structure whereby a total of five coil segments CS1 to CS5 and total of four relay segments IS1 to IS4 connecting the coil segments CS1 to CS5 are spirally integrated, where the number of windings is approx. 3.5. These internal conductors 20 are primarily obtained by heat-treating silver particles, where the d50 of silver particles used as the material is 5 μm based on volume.

The four coil segments CS1 to CS4 have a C shape, with one coil segment CS5 having a band shape, and the thickness and width of each of the coil segments CS1 to CS5 are approx. 20 μm and approx. 0.2 mm, respectively. The top coil segment CS1 continuously has an L-shaped leader part LS1 used for connecting to an external terminal, while the bottom coil segment CS5 continuously has an L-shaped leader part LS2 used for connecting to another external terminal. The relay segments IS1 to IS4 constitute pillars that penetrate through the magnetic layers ML1 to ML4, where the bore of each pillar is approx. 15 μm.

Each external terminal (not illustrated) extends over each longitudinal end face of the laminated inductor 1 as well as four side faces near this end face, and is approx. 20 μm thick. One external terminal connects to the terminal end of the leader part LS1 of the top coil segment CS1, while the other external terminal connects to the terminal end of the leader part LS2 of the bottom coil segment CS5. These external terminals were obtained primarily by heat-treating silver particles whose d50 based on volume was 5 μm.

[Manufacturing of Laminated Inductor]

A magnetic paste was prepared from 85 percent by weight of the soft magnetic alloy particles, 13 percent by weight of butyl carbitol (solvent) and 2 percent by weight of polyvinyl butyral (binder) specified in Table 1. The magnetic paste for the magnetic material part 10 was prepared separately from the magnetic paste for the top and bottom cover areas 30, 40. A doctor blade was used to coat each magnetic paste on the surfaces of plastic base films, which were then dried with a hot-air dryer under a condition of approx. 80° C. for approx. 5 minutes. The green sheets were thus obtained on the base films. Thereafter, the green sheets were cut to obtain first through sixth sheets of sizes corresponding to the magnetic layers ML1 to ML6 (refer to FIG. 3) and suitable for multi-part forming.

Next, a piecing machine was used to piece the first sheet corresponding to the magnetic layer ML1 to form a through hole according to a specified layout to correspond to the relay segment IS1. Similarly, through holes were formed in the second through fourth sheets corresponding to the magnetic layers ML2 to ML4, according to specified layouts to correspond to the relay segments IS2 to IS4, respectively.

Next, a printer was used to print, on the surface of the first sheet, a conductive paste constituted by 85 percent by weight of the above Ag particles, 13 percent by weight of butyl carbitol (solvent) and 2 percent by weight of polyvinyl butyral (binder), after which the paste was dried with a hot-air dryer under a condition of approx. 80° C. for approx. 5 minutes, to produce a first printing layer according to a specified layout to correspond to the coil segment CS1. Similarly, second through fifth printing layers were produced on the second through fifth sheets according to specified layouts to correspond to the coil segments CS2 to CS5, respectively.

Since the through holes formed in the first through fourth sheets are positioned by overlapping with the ends of the first through fourth printing layers, the conductive paste is partially filled in each through hole when the first through fourth printing layers are printed, to form first through fourth filled parts corresponding to the relay segments IS1 to IS4.

Next, a suction transfer machine and press machine were used to stack in the order shown in FIG. 3 and to thermopressure-bond the first through fourth sheets each having a printing layer and filled part, the fifth sheet having only a printing layer, and the sixth sheet having no printing layer or filled part, to produce a laminate. This laminate was cut to the component size using a cutting machine to obtain a chip-before-heat-treatment.

Next, a sintering furnace was used to heat-treat multiple chips-before-heat-treatment at once in atmosphere. The chips were first heated to approx. 300° C. for approx. 1 hour in the binder removal process, and then heated to approx. 750° C. for approx. 2 hours in the oxide film forming process. This heat treatment caused the soft magnetic alloy particles to gather densely to form the magnetic material part 10, while causing the silver particles to sinter and form the internal conductors 20, to obtain the component.

Next, external terminals were formed. A conductive paste containing 85 percent by weight of the above silver particles, 13 percent by weight of butyl carbitol (solvent) and 2 percent by weight of polyvinyl butyral (binder) was coated on both longitudinal ends of the component using a coating machine, and then the component was baked in a sintering furnace under a condition of approx. 800° C. for approx. 1 hour. As a result, the solvent and binder dissipated and silver particles were sintered to form the external terminals, and a laminated inductor 1 was obtained.

Example 2

A laminated inductor was obtained in the same manner as in Example 1, except that for the ML6 layers corresponding to the top and bottom cover areas, soft magnetic alloy particles with a D50 of 20 μm and soft magnetic alloy particles with a D50 of 3 μm were mixed at a weight ratio of 8:2.

Example 3

A laminated inductor was obtained in the same manner as in Example 1, except that for the magnetic layers ML1 to ML5, soft magnetic alloy particles having one peak in their particle size distribution curve, and containing Cr and Si with a D50 of 6 μm by 5 percent by weight and 5 percent by weight, respectively, with Fe accounting for the remainder, were used, and that for the ML6 layers corresponding to the top and bottom cover areas, soft magnetic alloy particles with a D50 of 10 μm and soft magnetic alloy particles with a D50 of 1.5 μm, both having the same composition as the soft magnetic alloy particles used for the magnetic layers ML1 to ML5, were mixed at a weight ratio of 8:2.

Example 4

A laminated inductor was obtained in the same manner as in Example 1, except that for the ML6 layers corresponding to the top and bottom cover areas, soft magnetic alloy particles with a D50 of 10 μm and soft magnetic alloy particles with a D50 of 1.8 μm were mixed at a weight ratio of 8:2.

Example 5

A laminated inductor was obtained in the same manner as in Example 1, except that for the magnetic layers ML1 to ML5, soft magnetic alloy particles having one peak in their particle size distribution curve, and containing Cr and Si with a D50 of 1.5 μm by 5 percent by weight and 3 percent by weight, respectively, with Fe accounting for the remainder, were used, and that for the ML6 layers corresponding to the top and bottom cover areas, soft magnetic alloy particles with a D50 of 10 μm and soft magnetic alloy particles with a D50 of 1.5 μm were mixed at a weight ratio of 8:2.

Example 6

A laminated inductor was obtained in the same manner as in Example 1, except that for the ML6 layers corresponding to the top and bottom cover areas, soft magnetic alloy particles with a D50 of 10 μm and soft magnetic alloy particles with a D50 of 1.5 μm were mixed at a weight ratio of 91:9.

Example 7

A laminated inductor was obtained in the same manner as in Example 1, except that for the ML6 layers corresponding to the top and bottom cover areas, soft magnetic alloy particles with a D50 of 10 μm and soft magnetic alloy particles with a D50 of 1.5 μm were mixed at a weight ratio of 67:33.

Example 8

A laminated inductor was obtained in the same manner as in Example 1, except that for the magnetic layers ML1 to ML5, soft magnetic alloy particles having one peak in their particle size distribution curve, and containing Al and Si with a D50 of 6 μm by 5.5 percent by weight and 9.5 percent by weight, respectively, with Fe accounting for the remainder, were used, and that for the ML6 layers corresponding to the top and bottom cover areas, soft magnetic alloy particles with a D50 of 10 μm and soft magnetic alloy particles with a D50 of 1.5 μm, both having the same composition as the soft magnetic alloy particles used for the magnetic layers ML1 to ML5, were mixed at a weight ratio of 8:2.

Comparative Example 1

A laminated inductor was obtained in the same manner as in Example 1, except that both the magnetic layers ML1 to ML5 and the ML6 layers corresponding to the top and bottom cover areas were made by soft magnetic alloy particles having one peak in their particle size distribution curve, and containing Cr and Si with a D50 of 10 μm by 5 percent by weight and 3 percent by weight, respectively, with Fe accounting for the remainder.

Comparative Example 2

A laminated inductor was obtained in the same manner as in Example 1, except that both the magnetic layers ML1 to ML5 and the ML6 layers corresponding to the top and bottom cover areas were made by soft magnetic alloy particles having one peak in their particle size distribution curve, and containing Al and Si with a D50 of 10 μm by 5.5 percent by weight and 9.5 percent by weight, respectively, with Fe accounting for the remainder.

The obtained laminated inductors were measured for a, b, c, t1 and t2. The obtained laminated inductors were also measured for certain characteristics, or namely the direct-current resistance (Rdc) and direct-current superimposed current (Idc), under a condition of inductance L being 1.0 μH. The percentage of defective inductors (N=50) was also measured. The results are summarized in Tables 1 and 2.

TABLE 1

| | Fe (wt %) | Si (wt %) | Cr (wt %) | a (μm) | b (μm) | c (μm) | t1 (%) | t2 (%) | Rdc (ohm) | Idc (A) | the percentage of defective inductors |
|---|---|---|---|---|---|---|---|---|---|---|---|
| Ex. 1 | 92 | 3 | 5 | 1.5 | 10 | 6 | 2 | 8 | 0.09 | 3.1 | 0% |
| Ex. 2 | 92 | 3 | 5 | 3 | 20 | 6 | 2 | 8 | 0.09 | 3 | 0% |
| Ex. 3 | 90 | 5 | 5 | 1.5 | 10 | 6 | 2 | 8 | 0.1 | 3 | 0% |
| Ex. 4 | 92 | 3 | 5 | 1.8 | 10 | 6 | 2 | 8 | 0.14 | 2.3 | 0% |
| Ex. 5 | 92 | 3 | 5 | 1.5 | 10 | 1.5 | 2 | 8 | 0.14 | 2.2 | 0% |
| Ex. 6 | 92 | 3 | 5 | 1.5 | 10 | 6 | 0.9 | 9 | 0.13 | 2.4 | 0% |
| EX. 7 | 92 | 3 | 5 | 1.5 | 10 | 6 | 2.5 | 5 | 0.13 | 2.2 | 0% |
| COM. EX. 1 | 92 | 3 | 5 | 10 | 10 | 10 | 10.5 | — | 0.16 | 2 | 50% |

TABLE 2

| | Fe (wt %) | Si (wt %) | Al (wt %) | a (μm) | b (μm) | c (μm) | t1 (%) | t2 (%) | Rdc (ohm) | Idc (A) | the percentage of defective inductors |
|---|---|---|---|---|---|---|---|---|---|---|---|
| EX. 8 | 85 | 9.5 | 5.5 | 1.5 | 10 | 6 | 2 | 8 | 0.15 | 2.8 | 0% |
| COM. EX. 2 | 85 | 9.5 | 5.5 | 10 | 10 | 10 | 10.5 | — | 0.2 | 2 | 60% |

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No. 2011-252099, filed Nov. 17, 2011, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A laminated inductor comprising:

an internal conductor forming area, and a top cover area and a bottom cover area formed in a manner sandwiching the internal conductor forming area from above and below;

wherein the internal conductor forming area has a magnetic material part constituted by soft magnetic alloy particles, and internal conductors embedded in the magnetic material part; and at least one of the top cover area and bottom cover area is constituted by soft magnetic alloy particles exhibiting a two-peak particle size distribution curve, based on count, said internal conductor forming area, top cover area, and bottom cover area being sintered, said two-peak particle size distribution curve being measured based on the sizes of individual soft magnetic alloy particles observed on a cross section of the at least one of the sintered top cover area and bottom cover area, said two-peak particle size distribution curve having a first peak and a second peak wherein soft magnetic alloy particles constituting the first peak and soft magnetic alloy particles constituting the second peak are made of the same constituent elements.

2. A laminated inductor according to claim 1, wherein the soft magnetic alloy particles in the magnetic material part of the internal conductor forming area have the same types of constituent elements as the soft magnetic alloy particles exhibiting a two-peak particle size distribution curve.

3. A laminated inductor according to claim 1, wherein a ratio of particle size a at a peak on a small particle size side and particle size b at a peak on a large particle size side of the two peaks, or a/b, is 0.18 or less.

4. A laminated inductor according to claim 1, wherein a ratio of height t1 at the peak on the small particle size side and height t2 at the peak on the large particle size side of the two peaks, or t1/t2, is 0.1 to 0.5.

5. A laminated inductor according to claim 1, wherein there is a relationship of a <c <b wherein a is a particle size at a peak on a small particle size side, b is a particle size at a peak on a large particle size side of the two peaks, and c is a particle size of a D50 particle of the soft magnetic alloy particles at the magnetic material part of the internal conductor forming area.

6. A laminated inductor according to claim 2, wherein a ratio of particle size a at a peak on the small particle size side and particle size b at a peak on the large particle size side of the two peaks, or a/b, is 0.18 or less.

7. A laminated inductor according to claim 2, wherein a ratio of height t1 at the peak on the small particle size side and height t2 at the peak on the large particle size side of the two peaks, or t1/t2, is 0.1 to 0.5.

8. A laminated inductor according to claim 3, wherein a ratio of height t1 at the peak on the small particle size side and height t2 at the peak on the large particle size side of the two peaks, or t1/t2, is 0.1 to 0.5.

9. A laminated inductor according to claim 2, wherein there is a relationship of a <c <b wherein a is a particle size at a peak on a small particle size side, b is a particle size at a peak on a large particle size side of the two peaks, and c is a particle size of a D50 particle of the soft magnetic alloy particles at the magnetic material part of the internal conductor forming area.

10. A laminated inductor according to claim 3, wherein there is a relationship of a <c <b wherein c is a particle size of a D50 particle of the soft magnetic alloy particles at the magnetic material part of the internal conductor forming area.

11. A laminated inductor according to claim 4, wherein there is a relationship of a <c <b wherein a is a particle size at a peak on a small particle size side, b is a particle size at a peak on a large particle size side of the two peaks, and c is a particle size of a D50 particle of the soft magnetic alloy particles at the magnetic material part of the internal conductor forming area.

12. A laminated inductor according to claim 1, wherein the soft magnetic alloy particles are bonded to each other by oxide films in the magnetic material part and in the at least one of the top cover area and bottom cover area, wherein the oxide films do not constitute the soft magnetic alloy particles exhibiting the two-peak particle size distribution curve.

* * * * *